US010796859B2

(12) United States Patent
Lutz et al.

(10) Patent No.: US 10,796,859 B2
(45) Date of Patent: Oct. 6, 2020

(54) HAND-HELD POWER TOOL

(71) Applicant: Robert Bosch GmbH, Stuttgart (DE)

(72) Inventors: Manfred Lutz, Filderstadt (DE); Peter Stierle, Pliezhausen (DE)

(73) Assignee: Robert Bosch GmbH, Stuttgart (DE)

( * ) Notice: Subject to any disclaimer, the term of this patent is extended or adjusted under 35 U.S.C. 154(b) by 167 days.

(21) Appl. No.: 16/041,413

(22) Filed: Jul. 20, 2018

(65) Prior Publication Data

US 2019/0080857 A1 Mar. 14, 2019

(30) Foreign Application Priority Data

Sep. 12, 2017 (DE) ..... 10 2017 216 015

(51) Int. Cl.
*H01H 9/06* (2006.01)
*B24B 23/02* (2006.01)
*B25F 5/02* (2006.01)

(52) U.S. Cl.
CPC ..... *H01H 9/06* (2013.01); *B24B 23/028* (2013.01); *B25F 5/02* (2013.01); *H01H 2217/008* (2013.01); *H01H 2231/048* (2013.01)

(58) Field of Classification Search
CPC ..... H01H 9/06; B24B 23/028; B25F 5/02
USPC ..... 173/162.1
See application file for complete search history.

(56) References Cited

U.S. PATENT DOCUMENTS

2014/0158391 A1* 6/2014 Xin ..... B24B 23/028 173/170
2017/0250038 A1* 8/2017 Esenwein ..... B25F 5/00

FOREIGN PATENT DOCUMENTS

DE 35 20 200 A1 3/1986
DE 196 52 764 A1 6/1998
DE 10 2011 089 735 A1 6/2013

* cited by examiner

*Primary Examiner* — Nathaniel C Chukwurah
(74) *Attorney, Agent, or Firm* — Maginot, Moore & Beck LLP

(57) ABSTRACT

A hand-held power tool, in particular an angle grinder, includes a tool receiver, a tool housing, and a drive motor arranged in the tool housing. The drive motor is configured to be switched on and off via an electric On/Off switch for driving the tool receiver. The hand-held power tool also includes an actuating device configured to actuate the On/Off switch. The actuating device has a pivotably mounted actuating element and a pivotably mounted pawl that is configured to be coupled to the actuating element. The pawl is further configured, in a free-running state, to move pivotably relative to the actuating element and, in an actuation state, to exert upon the actuating element an actuating force that actuates the actuating device.

20 Claims, 5 Drawing Sheets

HAND-HELD POWER TOOL

This application claims priority under 35 U.S.C. § 119 to patent application no. DE 10 2017 216 015.2, filed on Sep. 12, 2017 in Germany, the disclosure of which is incorporated herein by reference in its entirety.

BACKGROUND

The disclosure relates to a hand-held power tool, in particular an angle grinder. DE 10 2011 089 735 A1 discloses a power tool having at least one switching unit, which has at least one pivotably mounted pawl that is designed to actuate a switch. The pawl is mounted so as to be pivotable along an angular range of greater than 30°, about a pivot axis of the pawl.

SUMMARY

The disclosure is based on the object of improving a hand-held power tool by simple design means.

A hand-held power tool, in particular an angle grinder, having a tool receiver, and having a tool housing in which there is arranged a drive motor, that can be switched on and off via an electric On/Off switch, for driving the tool receiver, the hand-held power tool having an actuating device for actuating the On/Off switch.

According to the disclosure, the actuating device has a pivotably mounted actuating element, and a pivotably mounted pawl that can be coupled to the actuating element and that is designed, in a free-running state, to move pivotably relative to the actuating element and, in an actuation state, to exert upon the actuating element an actuating force that actuates the actuating device.

Usually, a single-piece or single-part actuating device, for at least indirectly actuating the On/Off switch, is arranged in the grip region of a handle housing of the hand-held power tool, and is designed to be actuated by one or more fingers of the operator. Owing to legal safety provisions, current actuating devices must be realized so as to comply with safety provisions such as, for example, a ball drop test, in which a ball is dropped onto the actuating device, or pawl. The drive motor must not be put into operation as a result. Nevertheless, there must be convenient manipulation of the actuating device. This has resulted, inter alia, in a plurality of concepts that, for example, increase an actuating force for actuating the actuating device in such a manner that the drive motor is not put into operation in such a ball drop test, or that even prevent action of an actuating force for actuating the On/Off switch.

The hand-held power tool according to the disclosure improves the actuating device significantly in comparison with the prior art.

The actuating device of the present disclosure can be realized in a compact and space-saving manner. The actuating device can also comply with the legally required safety provisions, and additionally improve the manipulation of the hand-held power tool.

Furthermore, the present disclosure can render possible a flexible arrangement of the On/Off switch, which may be arranged, for example, at least partly in the handle housing of the hand-held power tool in order to utilize fully, in a particularly optimal manner, the usually restricted structural space in a handle housing, but not to compromise an ergonomic design of the handle housing. The ergonomics of the handle housing can thus be optimally improved, without being limited by a design of the ergonomics of an On/Off switch arranged in the handle housing or of an actuating device arranged in the handle housing.

The On/Off switch may be realized in such a manner that a small operating travel, for example of less than 10 mm, in particular less than 8 mm, preferably less than 7 mm, preferably less than 7 mm, more preferably less than 4 mm, is sufficient to switch the On/Off switch on/off, in order to switch from an Off position to an On position of the On/Off switch, or distinguish between these, in a reliable manner. Consequently, it may suffice that the actuating device is pivotably mounted in such a manner that only a small pivot-angle range, for example of less than 30°, in particular less than 20°, preferably less than 15°, preferably less than 10°, is sufficient in order, in particular, to reliably switch the operating travel of the On/Off switch.

Upon an actuation of the On/Off switch, by means of a pivoting movement the pawl can be pivoted further in the direction of the handle housing, such that the pawl projects at least partly into the handle housing. In the case of this pivoting movement, the travel resistance is greater than at the beginning of the pivoting movement of the pawl. This is due to an additional driving of the actuating element, which, inter alia, may be spring-mounted, for example, and which thus seeks to put the actuating element back into its original position. The On/Off switch has a spring-mounted pushbutton for actuating the On/Off switch.

In other words, the actuating force to be applied by the operator increases as soon as the pawl touches, or moves, the actuating element, since the spring acting upon the actuating element is additionally tensioned. In particular, the pawl may be realized as a pivoted lever.

The actuating element may be designed to contact and actuate the On/Off switch, in at least one state.

The actuating element and/or the pawl may be spring-mounted, such that the actuating element and/or the pawl can be brought back from an actuation state into their non-operative states. For example, the actuating element and/or the pawl may be spring-mounted by means of at least one leg spring and/or at least one torsion spring, thereby enabling a compact, or space-saving, spring mounting to be achieved.

It is proposed that the pawl have a pivot-angle range having a, in particular minimum, idle stroke angle of more than 10°, in particular more than 20°, preferably more than 30°, preferably more than 40°, particularly preferably more than 50°, further preferably more than 60°. Preferably, the actuating element has a, in particular maximum, idle stroke angle of less than 100°, in particular less than 90°, preferably less than 80°, preferably less than 70°. An "idle stroke angle" is to be understood to mean, in particular, an angle that is traversed by the pawl in a movement, starting from a non-operative state, into a contact state, or an actuation state of the actuating device. Preferably, in the case of a movement, starting from the non-operative state, into the contact state, or the actuation state, the pawl may be movable in a contactless manner relative to the actuating element. A "contact state" is to be understood to mean a state in which the pawl contacts the actuating element, on a contact face, and preferably, upon a pivot movement of the pawl, drives it in an actuation state.

"Designed" is to be understood to mean, in particular, specially programmed, configured and/or equipped. That an element and/or a unit are/is designed for a particular function, is to be understood to mean, in particular, that the element and/or the unit fulfils/fulfill and/or executes/execute this particular function in at least one application state and/or operating state.

The actuating element may be in contact with the On/Off switch, on a side of the actuating element that faces away from the pawl.

A high degree of operating convenience can be realized by means of the design of the actuating device according to the disclosure.

Advantageously, a change in a lever arm, for the purpose of moving the actuating element in dependence on a movement of the pawl, can be achieved as a result of a movement of the at least one force introduction point on a contact surface. A small actuating force can be realized for the purpose of actuating the pawl, in particular realized as an operating lever. It is possible to achieve a convenient movement of the pawl, starting from the non-operative state, into the contact state, or actuation state, that can be achieved by action of a small operator force.

"Pivotably mounted" is to be understood to mean, in particular, a mounting of an element and/or of a unit, the element and/or the unit having a movement capability, in particular dissociated from an elastic deformation of the element and/or of the unit, about a pivot axis, along an angular range of more than 5°, preferably of more than 20°, and particularly preferably of more than 40°, and further preferably of more than 90°.

In particular, the actuating device is realized at least in two parts, and has at least one pawl and at least one actuating element.

The actuating device may be realized for indirect or for direct actuation of the On/Off switch.

The actuating device may be arranged on the tool housing so as to be pivotable about a pivot axis arranged transversely in relation to a direction of longitudinal extent of the tool housing.

The disclosure is described in the following primarily by using the example of a, in particular, manually guided, power tool, which has a tool receiving device that moves in a rotary manner about an output axis. This limitation of the illustration, however, is not to be understood as a limitation of the application possibilities of such a power tool.

A power tool is a device that has one or more drive motors and possibly one or more transmission devices, and that has at least one output shaft having—in the geometric sense—an output axis. The tool receiver is arranged, indirectly or directly, on the output shaft. The tool receiver is the component, or the components, by which the torque is applied to the tool, the tool receiver preferably also holding the tool, in particular in the case of a manually guided power tool, such that the tool is both held by, and receives the output torque from, the tool receiving device. The term output moment, and the terms formed with output, mean the moment transmitted by the power tool to the tool, or the corresponding components of the power tool. The term drive moment denotes the moment received by the tool.

A manually guided, or manually carried, power tool has a carrying device, in particular handles and the like, by which the power tool, with the tool fastened thereto, can be guided by an operator. Typically, manually guided power tools are provided with an electric drive motor, but other designs such as, for example, hydraulically or pneumatically operated power tools, are also known and applicable within the scope of the disclosure.

A "portable power tool" is to be understood here to mean, in particular, a power tool, for performing work on workpieces, that can be transported by an operator without the use of a transport machine. The portable power tool has, in particular, a mass of less than 40 kg, preferably less than 10 kg, and particularly preferably less than 5 kg. Particularly preferably, the portable power tool is realized as a power angle grinder. It is also conceivable, however, for the portable power tool to be of a different design, considered appropriate by persons skilled in the art, such as, for example, designed as a power circular saw, as a power drill, as a power jigsaw, as a power sander, or the like. The portable power tool preferably comprises an output shaft that can be driven in rotation.

In principle, suitable power tools are a non-stationary power tool such as, for example, a hand-held circular saw according to the application DE 3520200 A1, or such as, for example, a backpack-type brushcutter according to the application DE 19652764 A1.

The dependent claims specify further expedient developments of the hand-held power tool according to the disclosure.

It may be expedient for the actuating element to be arranged substantially in the tool housing, in particular a handle housing, and to be surrounded by this housing. In particular, the handle housing may substantially surround the actuating element in at least one plane. A particularly compact tool housing can thereby be achieved.

Furthermore, the actuating element may extend at least partly into a housing part of the tool housing that is adjacent to the handle housing. In particular, an end of the actuating element that faces away from the pivot axis of the actuating element may be arranged in a housing part of the tool housing that is adjacent to the handle housing. A particularly compact actuating device, rendering possible a particular ergonomic design of the handle housing, can thus be realized.

In addition, it may be expedient for the actuating element to have a maximum longitudinal extent that is less than a maximum longitudinal extent of the pawl. Furthermore, it may be expedient for the actuating element to be realized in the form of a bar. An actuating force can thus be transmitted in a particularly simple manner from the pawl to the actuating element. In the form of a bar is to be understood to mean a longitudinal extent that, in particular, is greater, by a multiple, than a transverse extent that is transverse to the longitudinal extent, in particular greater by at least 50%, preferably by at least 100%, preferably by at least 200%, further preferably by at least 300%.

It is proposed that, for the purpose of actuating the actuating element, the pawl have at least one pawl contact surface arranged on the pawl, and the actuating element have an actuation contact surface. The pawl contact surface may be arranged in such a manner that the pawl contact surface, when acting in combination with the actuation contact surface, moves the actuating element pivotably in dependence on a pivot movement of the pawl. In particular, the pawl, in the case of an actuation state, may have a force introduction point or a force introduction line that, when the pawl contact surface acts in combination with the actuation contact surface, is assigned to a force introduction point or to a force introduction line of the actuation contact surface. In the case of a force introduction line, the pawl contact surface may be realized so as to be movable, in an actuation state, relative to the actuation contact surface. The pawl contact surface of the pawl may be arranged such that it is adjacent to, in particular adjoins, the pivot axis of the actuating device or of the pawl. The actuation contact surface of the actuating element of the pawl may be arranged such that it is adjacent to, in particular adjoins, the pivot axis of the actuating device or of the actuating element. In particular, the pawl contact surface may extend substantially radially in relation to the pivot axis of the actuating element. The pawl can thus drive the actuating element in a particularly compact manner.

Preferably, when the pawl contact surface of the pawl and the actuation contact surface of the actuating element act in combination, a linear contact is effected between the pawl contact surface of the pawl and the actuation contact surface of the actuating element. The force introduction point of the actuating element is preferably arranged on a contact line of the actuation contact surface to the pawl contact surface. Preferably, a linear contact is effected, along the contact line, between the pawl contact surface of the pawl and the actuation contact surface of the actuating element. It is also conceivable, however, that, when the pawl contact surface of the pawl and the actuation contact surface of the actuating element act in combination, a punctiform contact is effected, the punctiform contact being effected at the at least one force introduction point of the actuating element and of the pawl. Preferably, the at least one force introduction point of the actuating element is constituted by a contact point of the pawl contact surface of the pawl, which is designed to bear against the contact surface of the actuating element when the pawl contact surface of the pawl and the actuation contact surface of the actuating element act in combination. It is also conceivable that, when the pawl contact surface of the pawl and the actuation contact surface of the actuating element act in combination, a planar contact is effected.

In addition, it may be expedient for the actuating element to have a pivot axis that is arranged coaxially with the pivot axis of the pawl. The actuating element may be arranged parallel to and spaced apart from the pivot axis of the pawl. A pivot movement of the actuating element, in an actuation state, can thus be set particularly easily, in that the pivot movement, in particular a travelled pivot angle movement of the pawl may be, for example different, in particular greater or less than, a pivot movement, in particular a travelled pivot angle movement, of the actuating element in an actuation state. Consequently, the actuating element can be actuated particularly reliably the pawl.

It is additionally proposed that the pawl have a pivot angle range about the pivot axis that is greater than a pivot angle range of the actuating element about a/the pivot axis of the actuating element. A "pivot angle range" is to be understood to mean, in particular, a maximum pivot range about at least one pivot axis of the actuating element and of the pawl. An actuating time-point that is optimal for an operator of the hand-held power tool can thus be set.

It is proposed that the pawl have a pivot angle range $\alpha''$ in a free-running state, and a pivot angle range $\alpha'$ in an actuation state, the pivot angle range $\alpha''$ being greater, by up to 700%, in particular by up to 500%, preferably by up to 300%, preferably by up to 100%, than the pivot angle range $\alpha'$. Inadvertent actuation of the actuating device can thereby be prevented, in that the actuating operation that actuates the On/Off switch is effected only upon passage through a large pivot angle range of the free-running state.

It is further proposed that the pawl have a pivot angle range $\alpha$ that comprises at least 180°, in particular at least 150°, preferably at least 120°, preferably at least 90°, particularly preferably at least 60°. Safety of the actuating device can thus be increased in that, in order to actuate the actuating device, the pawl must be pivoted by a large pivot angle, such that inadvertent actuation is avoided.

It may be expedient for a pivot angle range of the pawl in the actuation state to be less than a pivot angle range of the actuating element in the actuation state. In particular, a pivot angle range of the pawl in the actuation state may correspond to pivot angle range of the actuating element in the actuation state. It is thereby possible to set a force acting upon the actuating element.

It may additionally be expedient for the pawl to have an at least portionally, in particular convexly, curved pawl actuating surface that is designed to actuate the actuating device, or the actuating element, by means of an actuating force acting, in particular orthogonally, upon the pawl actuating surface. The pawl actuating surface is intended to constitute a contact surface for actuation of the actuating device by means of a finger of the operator. It is thereby possible to realize a pawl contact surface that is optimally adapted to one or two fingers of an operator, and that reduces a pressure, or the surface pressure, upon the finger or fingers.

It is further proposed that the handle housing have a handle region that is designed to be encompassed by an operator of the hand-held power tool. It is furthermore proposed that the pawl have a non-operative state, in which the pawl is arranged in such a manner that the pawl actuating surface is supported on a support region of the tool housing, in particular of the handle housing, that is adjacent to, in particular adjoins, the handle region. In particular, the pawl actuating surface, in a non-operative state, may face away from the handle region. It is thereby possible for the operator, for example using one finger of a hand encompassing the handle region, to grip the pawl and draw it to the handle region. The hand-held power tool and the actuating device can thereby be operated with one hand. Furthermore, an operator can grip the tool housing without inadvertently actuating the pawl in such a manner that the drive motor of the hand-held power tool is operated.

It may additionally be expedient for the pawl to have a maximum longitudinal extent, and a maximum transverse extent that extends transversely, in particular orthogonally, in relation to the longitudinal extent, the maximum longitudinal extent being greater than the maximum transverse extent by up to 100%, in particular by up to 70%, preferably by up to 50%, preferably by up to 40%, particularly preferably by up to 30%.

It may furthermore be expedient for the pawl to surround the handle housing, in particular the handle region, in a plane extending in particular orthogonally in relation to a direction of longitudinal extent of the handle housing, by up to 90°, in particular by up to 70°, preferably by up to 60°, preferably by up to 50°, particularly preferably by up to 40°, and/or by at least 10°, in particular at least 20°, preferably at least 30°, in the circumferential direction of the handle housing. A surface pressure to be applied to the pawl, in particular to the pawl actuating surface of the pawl, by an operator of the hand-held power tool for the purpose of applying the required actuating force can thereby be reduced, such that the pressure upon a finger of the operator is distributed over a large, and in particular ergonomic, surface area. Operation of the actuating device can thus also be effected by means of only a single finger of the operator, in that a pivot angle range and kinematics of the actuating device are configured in such a manner that the actuating force of at least one finger of an operator can be applied.

Furthermore, it may be expedient to provide a locking device, which is designed to hold the actuating device, in particular the pawl and the actuating element, in an actuation state. The locking device may have, in particular, at least one locking element. The locking device may be designed to connect the actuating device in a form-fitting manner, at least in the actuation state. A "locking element" is to be understood to mean, in particular, an element designed to be brought into contact with another locking element such as, for example, a receiving element, for the purpose of locking, such that a locking force can be transmitted via the two locking elements. The actuating device can thus be held in an actuation state of the hand-held power tool.

BRIEF DESCRIPTION OF THE DRAWINGS

Further advantages are disclosed by the following description of the drawings. Exemplary embodiments of the disclosure are represented in the drawings. The drawings, the description, and the claims contain numerous features in combination. Persons skilled in the art will also expediently consider the features individually and combine them to create appropriate further combinations.

There are shown in.

DETAILED DESCRIPTION

In the figures that follow, components that are the same are denoted by the same references.

Figure 1:
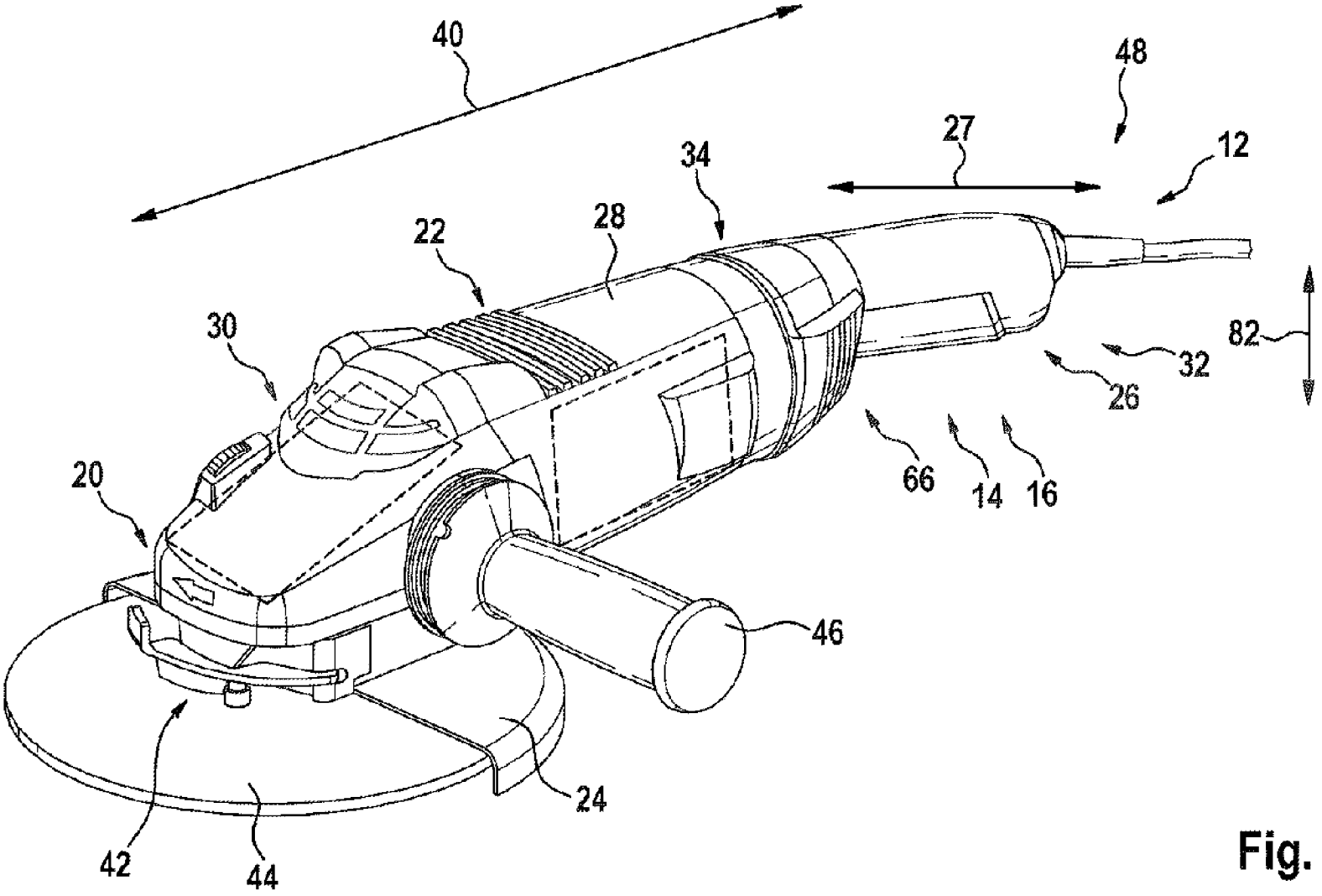
FIG. 1 a perspective view of the hand-held power tool according to the disclosure, FIG. 2 an enlarged detail of the hand-held power tool from FIG. 1, in a non-operative state, FIG. 3 a further enlarged detail of the hand-held power tool from FIG. 1, in a non-operative state, FIG. 4 an enlarged detail of the hand-held power tool from FIG. 1, in an actuation state, FIG. 5 an enlarged detail of the hand-held power tool from FIG. 1, in an actuation state, FIG. 6 a perspective view of a further embodiment hand-held power tool, in a non-operative state, FIG. 7 an enlarged detail of the hand-held power tool from FIG. 6, in a free-running state, and FIG. 8 an enlarged detail of the hand-held power tool from FIG. 6, in an actuation state.
Figure 2:
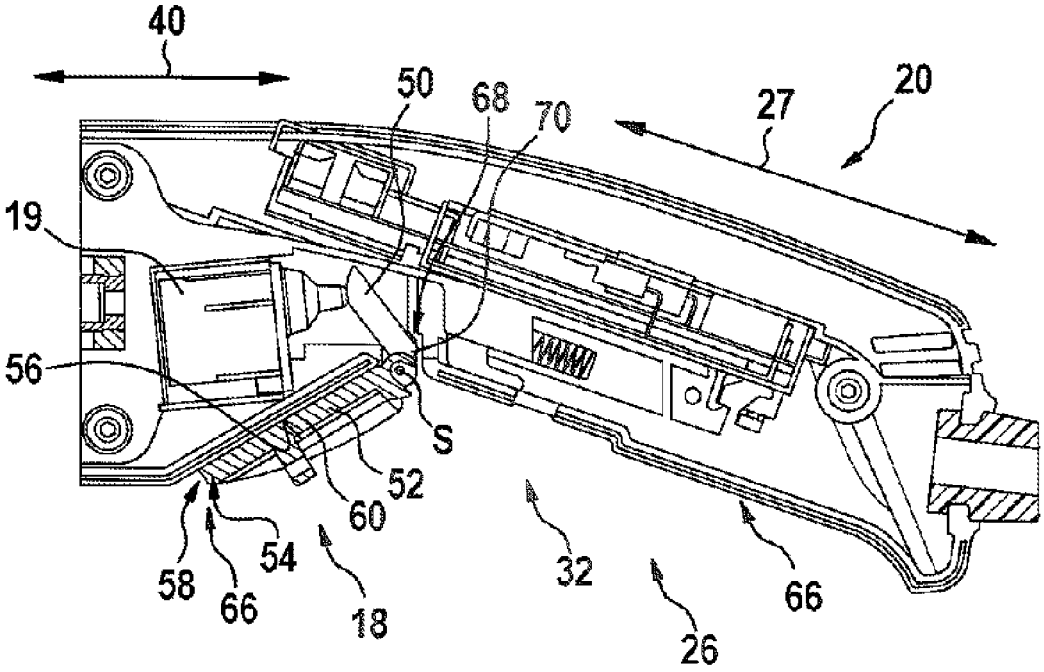

FIG. 1 shows a power tool 12, which is constituted by a portable power tool 12 realized as a power angle grinder. The portable power tool 12 comprises at least one switching unit 14, which has at least one pivotably mounted actuating device 16 for actuating at least one electric On/Off switch 19 (FIG. 2). In addition, a drive motor (not shown), which can be switched on and off via the On/Off switch 19, for driving a tool receiver 20, is arranged around a tool housing 22.

The power tool 12 additionally comprises a protective hood device 24, a handle housing 26, a drive housing 28 and an output housing 30. In an alternative embodiment, however, these housing parts may be realized as a single part, or single piece. A stem-type handle region 32 of the handle housing 26 in this case constitutes a main handle of the portable power tool 12. The main handle extends, at least substantially, starting from a connection region 34 of the handle housing 26 to the drive housing 28, in a direction away from the connection region 34, as far as a side 36 of the handle housing 26, arranged on which is a cable of the portable power tool 12 for supplying energy. The stem-type handle region 32 of the handle housing 26 has a direction of longitudinal extent 27. The handle region 32 is inclined by an angle of less than 30° relative to a direction of longitudinal extent 40 of the drive housing 28, or of the tool housing 22. A direction of longitudinal extent is to be understood to mean, in particular, a direction of main extent of a component that describes a maximum extent of the component.

Extending out of the output housing 30 there is an output shaft, realized as a spindle (not represented in greater detail here) of an output unit 42 of the portable power tool 12, to which a work tool 44, for performing work on a workpiece (not represented in greater detail here), can be fixed. The work tool 44 is realized as a grinding disc. It is also conceivable, however, for the work tool 44 to be realized as a cutting or polishing disc. The portable power tool 12 comprises the drive housing 28, for accommodating a drive unit (not shown) of the portable power tool 12, and the output housing 30, for accommodating the output unit 42. The drive unit is designed to drive the work tool 44 in rotation via the output unit 42. The work tool 44 in this case may be connected to the spindle in a rotationally fixed manner by means of a fastening element (not represented in greater detail here) for the purpose of performing work on a workpiece. Thus, when the portable power tool 12 is in operation, the work tool 44 can be driven in rotation. The output unit 42 is connected to the drive unit, via a drive element (not represented in greater detail here) of the drive unit that is realized as a pinion and that can be driven in rotation, in a manner already known to persons skilled in the art. In addition, there is an ancillary handle 46 arranged on the output housing 30. The ancillary handle 46, when mounted on the output housing 30, extends transversely in relation to the direction of longitudinal extent 40 of the power tool 12.

Represented in FIG. 2 is a section through the stem-type handle region 32 of the handle housing 20 from FIG. 1. The handle region 32 has an actuating device 16 for at least indirectly actuating the On/Off switch 19. The actuating device 18 is arranged on the handle region 32. The actuating device 18 is arranged on the handle housing 20 so as to be pivotable at least about a pivot axis S arranged transversely in relation to a direction of longitudinal extent 27 of the handle housing 20.

The actuating device 18 has a pivotably mounted actuating element 50, and a pivotably mounted pawl 52 that can be coupled to the actuating element 50. The pawl 52 is arranged at least substantially outside the handle housing 20. A pivoting movement of the pawl 52 is delimited by the handle housing 20, such that the pawl 52 arranged between the handle region 32 and a contact bearing region 54 of the handle housing 20 that is arranged adjacently to the handle region 32. Alternatively, the support region 54 may be arranged on a drive housing 28 that is connected to the handle housing 20. The support region 54 is arranged adjacently to the connection region 34, on a side that faces away from the connection region 34. The support region 54 in this case serves to support the pawl 52 in a non-operative state, and in this case constitutes a first dead-center position of the pawl 52. The pawl 52 has a pawl actuating surface 56, which is designed to be contacted directly by means of a finger of an operator for the purpose of actuating the actuating device 18. The pawl actuating surface 56 is realized in such a manner that, for the purpose of actuating the pawl 52, an operator grips the pawl actuating surface 56 with at least one finger of one hand of the operator, and easily pivots the pawl 52 about the pivot axis S. The pawl actuating surface 56 contacts the support region 54 at least portionally when in a non-operative state.

The support region 54 has at least one support cavity 58 that accommodates the pawl 52. The support cavity 58 contacts the pawl actuating surface 56 at least portionally. The receiving cavity 58 is designed to accommodate and securely support the pawl 52, or the pawl actuating surface 56 of the pawl 52.

The pawl actuating surface 56 is curved convexly. The pawl actuating surface 56 is designed to actuate the actuating element 50 by means of an actuating force that acts, in particular orthogonally, upon the pawl actuating surface 56.

The pawl actuating surface 56 extends by means of two actuating wings 60 that delimit the pawl 52 in a direction transverse to the direction of longitudinal extent 27 of the handle housing 20. The actuating wings 60 are designed in such a manner that, when the pawl 52 is supported in the receiving cavity 58, the pawl actuating surface 56 forms a contact space between the pawl actuating surface 56 and the support region 54 surrounding the receiving cavity 58. The contact space is designed to enable an operator to comfortably effect contact using one finger. The pawl actuating surface 56 is only partly supported in the receiving cavity 58 and, by means of the actuating wings 60, projects out from the receiving cavity 58 or the support region 54 surrounding the receiving region 58. The pawl 52 can thus be pivoted particularly easily, about the pivot axis 18, out of the non-operative state, by means of an application of force to the pawl actuating surface 56.

The actuating element 50 is arranged substantially within the handle housing 20 and is surrounded, substantially in one plane, around 360°, by the handle housing 20. The actuating element 50 extends within the handle housing 20, starting from a handle region 32, toward the connection region 46.

Figure 3:
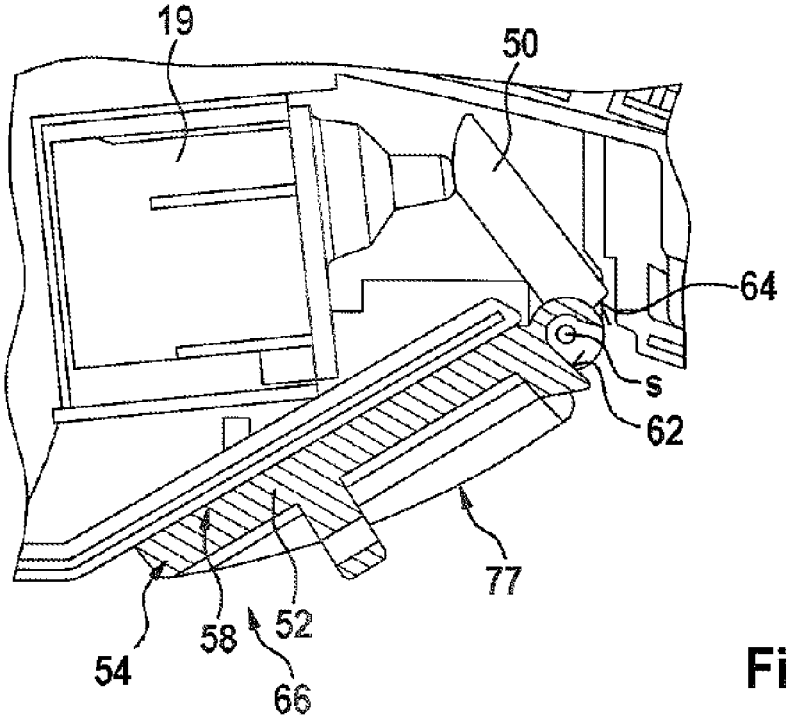

FIG. 3 additionally shows a detail view of the actuating device 18, which has the movably mounted pawl 52 for actuating the actuating element 50. The pawl 52 is mounted so as to be pivotable, about the pivot axis S of the pawl 52 arranged on the handle region 32 of the handle housing 20, along a pivot angle range α of greater than 90° and less than 150°. The pawl 52 is mounted so as to be pivotable about the pivot axis S, starting from a non-operative state, along a pivot angle range α of approximately 110°. The non-operative state of the pawl 52 corresponds to an unactuated state of the pawl 52.

The pawl 52 is designed, in a free-running state, to move pivotably relative to the actuating element 50 and, in an actuation state, to exert upon the actuating element 50 an actuating force that actuates the pawl 52.

The pawl 52 has a pawl contact surface 62, arranged at least on the pawl 52, for actuating the actuating device 18. The actuating element 50 has an actuation contact surface 64. The pawl contact surface 62 is arranged in such a manner that at least one force introduction point of the pawl contact surface 62, when acting in combination with the actuation contact surface 64 of the actuating element 50, realized on the actuating element 50, can be moved pivotably in dependence on a pivot movement of the pawl 52.

The pawl contact surface 62 and the actuation contact surface 64 are flat, such that a pivot movement, starting from the actuating force applied to the pawl 52, is transmitted from the pawl contact surface 62 to the actuation contact surface 64.

The handle housing 20, or the handle region 32, additionally comprises at least one grip surface 66, at least the pawl actuating surface 56 of the pawl 52, in at least one operating state such as, for example, the non-operative state, being arranged at an angle in relation to the grip surface 66 (FIG. 2). The grip surface 66 is arranged on the handle region 32, which forms the handle housing 20 of the portable hand-held power tool 12. When the pawl 52 is in the actuation state, the pawl actuating surface 56 is arranged parallel to the grip surface 66.

When the pawl actuating surface 56 is supported in the receiving cavity 58, the pawl 52, in the non-operative state, is at least substantially decoupled from a direct application of force in the form of an actuating force of an operator upon the pawl 52, since an operator of the hand-held power tool, upon intuitively gripping the hand-held power tool on the handle region 32 of the handle housing 20, cannot inadvertently actuate the pawl actuating surface 56 in such a manner that the actuating device 18, and in particular the On/Off switch 19, becomes actuated.

Figure 4:
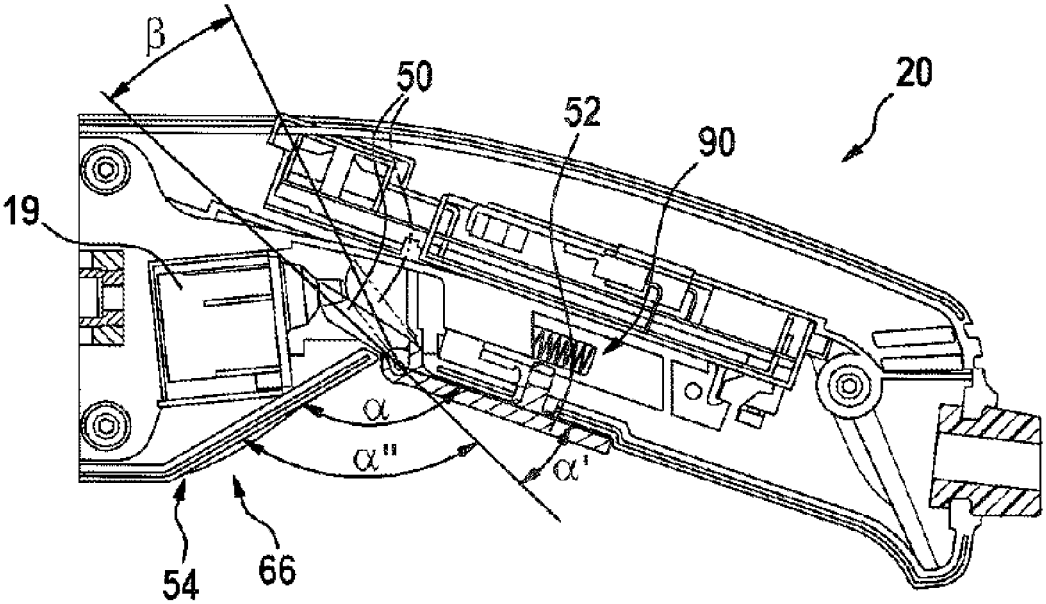

In FIG. 4 (actuation state), the pawl 52, in particular the pawl actuating surface 56, has a maximum longitudinal extent in the direction of longitudinal extent 28, and a maximum transverse extent that extends transversely, in particular orthogonally, in relation to the direction of longitudinal extent 28, the maximum longitudinal extent being by up to 70% greater than the maximum transverse extent.

In the case of a pivot angle range α of more than 90°, at least one direction of action of a force component, of at least two mutually perpendicular force components of the actuating force, changes upon actuation of the pawl 52, starting from the free-running state, to the actuation state, thereby ensuring that the pawl 52 cannot be actuated inadvertently.

The pawl 52 surrounds the handle region 32 of the handle housing 20, in a plane extending orthogonally in relation to the direction of longitudinal extent 27 of the handle housing 20, by up to 70° in the circumferential direction, around the direction of longitudinal extent 27 of the handle housing 20.

The actuating element 50 has a maximum extent that is less than a maximum extent of the pawl 52. The actuating element 50 is elongate and realized in the form of a bar.

The pawl 52 has a pivot angle range α about the pivot axis S that is greater than a pivot angle range β of the actuating element 50 about the pivot axis S of the actuating element 50. The pivot angle range α' of the pawl 52 is equal to a pivot angle range β of the actuating element 50 in the actuation state. The pawl 52 has a pivot angle range α" in a free-running state, and has a pivot angle range α' in an actuation state, the pivot angle range α" being up to 500%, and at least 300%, greater than the pivot angle range α'.

The pivot axis S of the pawl 52 runs at least substantially transversely in relation to the direction of longitudinal extent 27 of the handle housing 20, or to the direction of longitudinal extent of the portable power tool 12. The pivot axis S in this case runs at least substantially perpendicularly in relation to the direction of longitudinal extent 27 of the handle housing 20, or to the direction of longitudinal extent 40 of the portable power tool 12.

Furthermore, the switching unit 14 has at least one spring unit 68, which is designed at least to apply a spring force to the pawl 52 in the direction of the non-operative state of the pawl 52. The spring unit 68 is thus designed to realize a dead-man's circuit that, starting from an actuation state of the pawl 52, causes the pawl 52 to be reset automatically, following removal of an application of force upon the pawl 52 by an operator, to the non-operative state of the pawl 52. For this purpose the spring unit 68 has at least one spring element 70. The spring element 70 is realized as a leg spring or a torsion spring. In addition, the spring element 70, in a mounted state, is arranged with one end on the pawl 52. The spring element 68 is fixed with another end on the handle housing 20. Alternatively, the other end may be fixed on the actuating element 50.

The pawl actuating surface 56 of the pawl 52 has a longitudinal extent extending along a at least substantially perpendicular to the pivot axis S. The maximum longitudinal extent of the pawl actuating surface 56 corresponds at least substantially to 30% of a maximum longitudinal extent of the grip surface 66 of the handle region 32, as viewed along the direction of longitudinal extent 27 of the handle housing 20 (FIG. 2). The pawl actuating surface 56 additionally has a maximum transverse extent, extending along a direction of transverse extent 82 of the pawl 52, which corresponds at least substantially to 70% of a maximum transverse extent of the grip surface 66 of the grip surface 66 that extends at least substantially parallel to the pivot axis S. The direction of transverse extent 82 extends at least substantially parallel to the pivot axis S.

The pawl 52, in at least one actuation state, is at least partly supported on the grip surface 66 (FIG. 4). The pawl actuating surface 56 of the pawl 52 in this case is at least partly supported on the grip surface 66 of the handle region 32. The pawl actuating surface 56, in an actuation state, is substantially parallel to the grip surface 66. When the pawl 52 is in an actuated state, in which the pawl 52 is pivoted at least along a pivot angle range of more than 80°, about the pivot axis S, by an operator, the pawl begins to drive the actuating element 50, realized as an operating lever, and to actuate the On/Off switch 19 by means of the actuating element 50.

As soon as the actuating element 50 strikes against the grip surface 66 as a result of a pivot movement of the pawl 52 about the pivot axis S, the actuating element 52, realized as an operating lever, is fully actuated and thus, by means of actuation of the On/Off switch 19, closes an electric circuit for feeding electric current to the drive unit 42, for the purpose of putting the portable power tool 12 into operation. The On/Off switch 19 is fixedly arranged in a recess of the handle housing 26, or alternatively in the drive housing.

Furthermore, the switching unit 14 has a locking device 72 (FIG. 5), which is designed to hold the pawl 52 in an actuation state of the pawl 52 impacted by a spring force, in that an automatic resetting of the pawl 52 is prevented by means of a form-fit connection. The spring force is applied by means of a further spring element 73 that is assigned to the locking device 72. The spring element 73 is realized as a tension/compression spring. Alternatively, however, other spring elements appropriate for the intended application and function are also possible.

Figure 5:
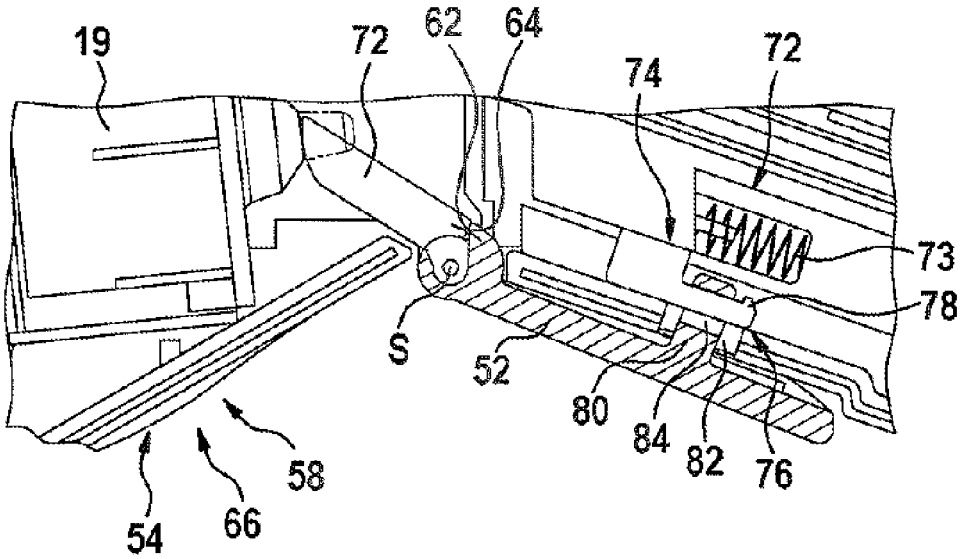

The locking device 72 has a spring-mounted and movably mounted locking element 74, realized as a locking slide, which comprises a locking extension 76 (FIG. 5). The locking extension 76 is designed to hold the pawl 52 and the actuating element 50 in the actuation state, in a state locked by means of the locking extension 76. The locking extension 76, in an actuation state, extends substantially parallel to a direction of longitudinal extent 27.

The locking extension 76 has an extension protuberance 78, realized as a locking lug, which is designed to hold the locking element 74, impacted by a spring force, in a form-fitting manner contrary to an effective direction of the biased of the spring element 73. The extension protuberance 78 extends substantially orthogonally in relation to a longitudinal extent of the pawl 52, and extends in a direction away from the pawl actuating surface 56 in an actuation state.

For this purpose, the pawl 52 has a receiving element 80. The receiving element 80 extends substantially orthogonally in relation to the pawl actuating surface 56 of the actuating element 50, and has a receiving through-opening 82, or receiving through-passage 82, that is designed to put through and receive the locking extension 76 in an actuation state.

The receiving element 80 is designed, in the actuation state, to engage at least partly in a locking recess 82 provided on the handle housing 20. The locking recess 82 in this case is arranged in the grip surface 66 of the handle housing 20. The locking recess 82 is realized as a locking through-opening that goes through a housing wall of the handle housing 20. The receiving element 80 is designed, in an actuation state, to engage through the housing wall of the handle housing 20 and, by means of the locking element 74, to engage at least partly through a receiving through-opening 84 realized in the locking element 74. The locking device can thereby hold the pawl 52 in a form-fitting manner in the actuation state, or the locking state. The extension protuberance 78 in this case secures the locking element 74 in a form-fitting manner against unwanted release of the receiving element 80, or of the pawl 52, in the locking state. The locking recess 82 in this case surrounds the receiving element 80 of the pawl 52 in a locking state, in a plane extending substantially parallel to the grip surface 66, around 360°.

Figure 6:
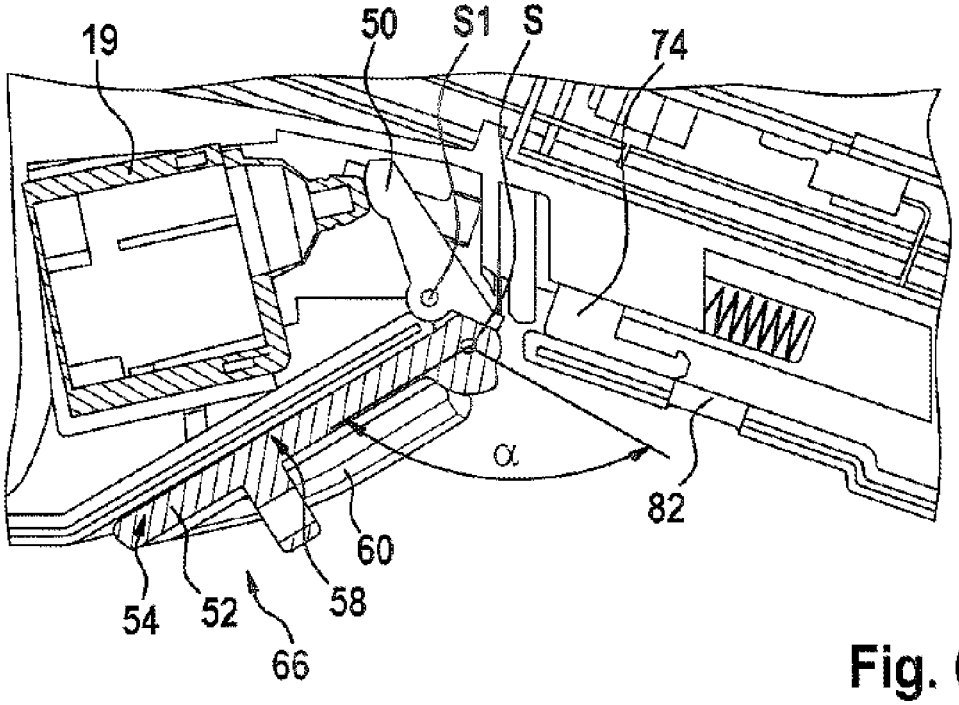

In a further embodiment (FIG. 6), the actuating device 18 has a further pivot axis S1, which is arranged parallel to and spaced apart from the pivot axis S. The actuating element 50 is mounted so as to be pivotable about the pivot axis S1, and the pawl 52 is mounted so as to be pivotable about the pivot axis S.

The pawl contact surface 62 is arranged in such a manner that at least one force introduction point of the pawl contact surface 62, when acting in combination with the actuation contact surface 64 of the actuating element 50, realized on the actuating element 50, can be moved pivotably in dependence on a pivot movement of the pawl 52.

The pawl contact surface 62 is at least partially curved. The actuation contact surface 64 is at least partially flat. The pawl contact surface 62 has a cam-type contour, such that the pawl contact surface 62 can at least partly roll on the actuation contact surface 64, and changes a pivot angle movement of the actuating element 50 in dependence on the cam-type contour.

Owing to the cam-type contour, as the pawl contact surface 62 rolls on the actuation contact surface 64, the a distance of the cam-type contour from the pivot axis of the actuating element 50 changes.

Figure 7:
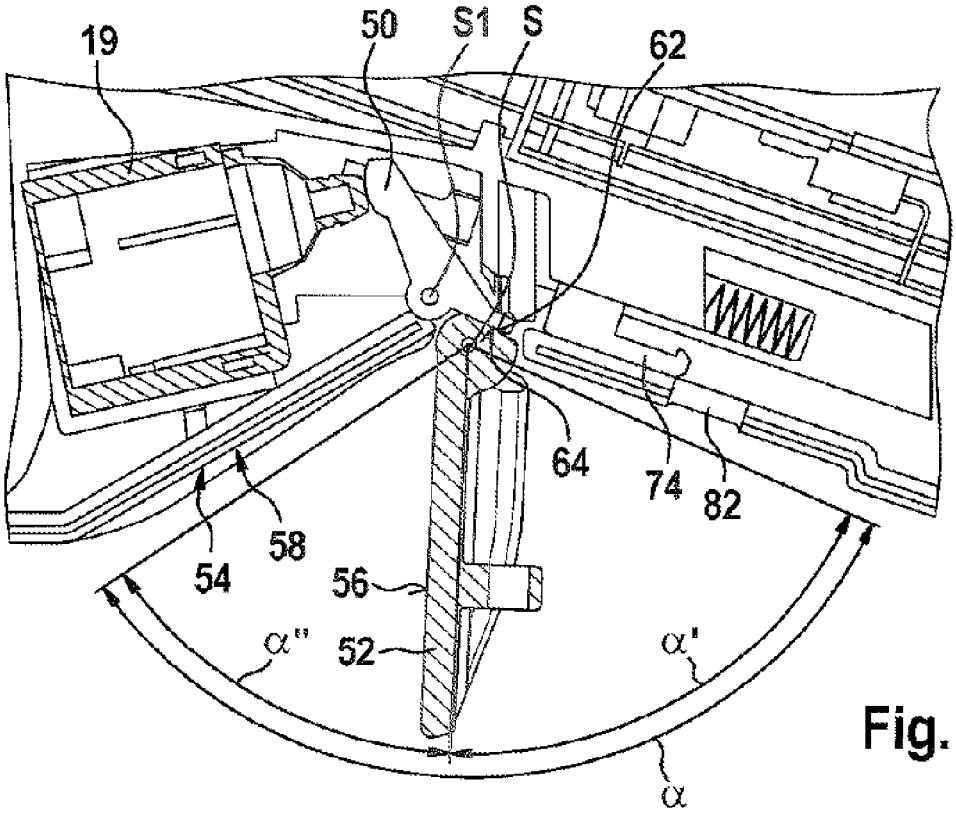
Figure 8:
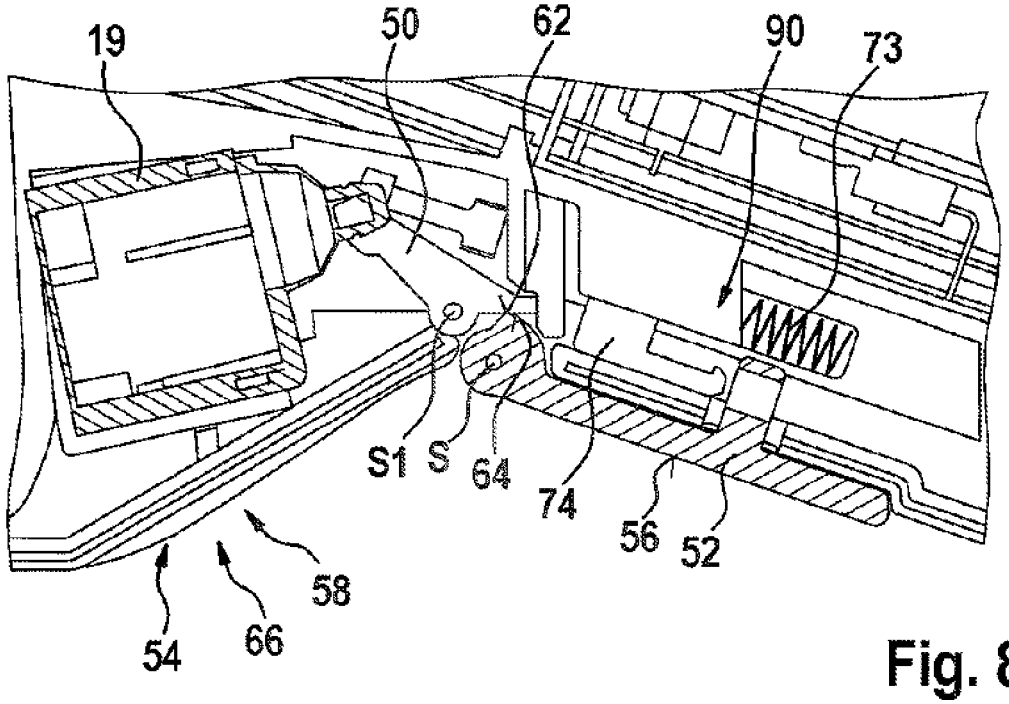

The pivot angle range $\alpha'$ of the pawl 52 in the actuation state is greater than the pivot angle range $\beta$ of the actuating element 50 in the actuation state. The pawl 52 has a pivot angle range having an idle stroke angle $\alpha''$ of approximately 90° (FIG. 4) and of approximately 55° (FIG. 7). Preferably, in the case of a movement starting from the non-operative state into the contact state or the actuation state, the pawl 52 can be moved in a contactless manner in relation to the actuating element 50. The pivot angle range $\alpha''$ is greater, by up to 100%, than the pivot angle range $\alpha'$ of the pawl 52 (FIG. 7).

What is claimed is:

1. A hand-held power tool, comprising:

a tool receiver;

a tool housing;

a drive motor arranged in the tool housing and configured to drive the tool receiver, the drive motor further configured to be switched on and off via an electric On/Off switch; and an actuating device configured to actuate the On/Off switch, the actuating device having a pivotably mounted actuating element and a pivotably mounted pawl configured to be coupled to the actuating element, wherein the pawl is further configured, in a free-running state, to move pivotably relative to the actuating element without exerting an actuating force upon the actuating element and, in an actuation state, to exert upon the actuating element the actuating force that actuates the actuating device.

2. The hand-held power tool according to claim 1, wherein the actuating element is arranged substantially in the tool housing and is surrounded by the tool housing.

3. The hand-held power tool according to claim 2, wherein the actuating element is arranged substantially in a handle housing of the tool housing and is surrounded by the handle housing.

4. The hand-held power tool according to claim 3, wherein the handle housing has handle region that is configured to be encompassed by an operator of the hand-held power tool, the pawl having a non-operative state, in which the pawl is arranged such that the pawl actuating surface is supported on a support region of the handle housing that adjoins the handle region.

5. The hand-held power tool according to claim 3, wherein in an actuation state, the pawl surrounds the handle housing in a plane extending in relation to a direction of longitudinal extent of the handle housing by up to 90° in the circumferential direction of the handle housing.

6. The hand-held power tool according to claim 1, wherein the actuating element is configured as a bar and has a maximum longitudinal extent that is less than a maximum longitudinal extent of the pawl.

7. The hand-held power tool according to claim 1, further comprising at least one pawl contact surface arranged on the pawl, an actuation contact surface arranged on the actuating element, wherein a pivot movement of the pawl causes the pawl contact surface to act on the actuation contact surface to pivotably move the actuating element.

8. The hand-held power tool according to claim 1, wherein the actuating element has a pivot axis that is arranged coaxially with, or parallel to and spaced apart from, the pivot axis of the pawl.

9. The hand-held power tool according to claim 1, wherein the pawl has a first pivot angle range about a first pivot axis that is greater than a second pivot angle range of the actuating element about a second pivot axis of the actuating element.

10. The hand-held power tool according to claim 1, wherein the pawl has a first pivot angle range in a free-running state, and a second pivot angle range in an actuation state, the first pivot angle range being greater, by up to 700%, than the second pivot angle range.

11. The hand-held power tool according to claim 10, wherein the first pivot angle range is greater, by up to 100%, than the second pivot angle range.

12. The hand-held power tool according to claim 1, wherein the pawl has a pivot angle range that comprises at least 180°.

13. The hand-held power tool according to claim 12, wherein the pivot angle range comprises at least 60°.

14. The hand-held power tool according to claim 1, wherein a first pivot angle range of the pawl in the actuation state is greater than or equal to a second pivot angle range of the actuating element in the actuation state.

15. The hand-held power tool according to claim 1, wherein the pawl has an at least portionally curved pawl actuating surface that is configured to actuate the actuating device by an actuating force acting upon the pawl actuating surface.

16. The hand-held power tool according to claim 15, wherein the at least portionally curved pawl actuating surface is a convexly curved pawl actuating surface, and wherein the actuating force acts orthogonally upon the pawl actuating surface.

17. The hand-held power tool according to claim 1, wherein the pawl has a maximum longitudinal extent, and a maximum transverse extent that extends transversely in relation to the longitudinal extent, the maximum longitudinal extent being greater than the maximum transverse extent by up to 100%.

18. The hand-held power tool according to claim 17, wherein the maximum transverse extent extends orthogonally in relation to the longitudinal extent, and wherein the maximum longitudinal extent is greater than the maximum transverse extent by up to 30%.

19. The hand-held power tool according to claim 1, further comprising a locking device configured to hold the actuating device and the actuating element in an actuation state.

20. A portable power tool, comprising:

a hand-held power tool, the hand-held power tool including:

a tool receiver;

a tool housing;

a drive motor arranged in the tool housing and configured to drive the tool receiver, the drive motor further configured to be switched on and off via an electric On/Off switch; and an actuating device configured to actuate the On/Off switch, the actuating device having a pivotably mounted actuating element and a pivotably mounted pawl configured to be coupled to the actuating element, wherein the pawl is further configured, in a free-running state, to move pivotably relative to the actuating element without exerting an actuating force upon the actuating element and, in an actuation state, to exert upon the actuating element the actuating force that actuates the actuating device.

* * * * *